US005797066A

United States Patent [19]

Kishigami et al.

[11] Patent Number: 5,797,066

[45] Date of Patent: Aug. 18, 1998

[54] LIGHT SOURCE DRIVE CONTROLLING DEVICE FOR USE IN IMAGE FORMING APPARATUS

[75] Inventors: Norimasa Kishigami; Kotaro Kawasaki; Mitsuharu Yoshimoto; Atsushi Yoshihara, all of Osaka, Japan

[73] Assignee: Mita Industrial Co., Ltd., Osaka-fu, Japan

[21] Appl. No.: 858,313

[22] Filed: May 19, 1997

[30] Foreign Application Priority Data

Jun. 3, 1996 [JP] Japan ..... 8-140460

[51] Int. Cl.[6] ..... G03G 15/04

[52] U.S. Cl. ..... 399/51; 358/497; 399/138; 399/211

[58] Field of Search ..... 399/51, 138, 211; 358/474, 497; 347/229, 235, 246, 247, 250; 355/75, 84

[56] References Cited

U.S. PATENT DOCUMENTS 4,640,603 2/1987 Honna ..... 399/138 X
5,030,994 7/1991 Roman et al. ..... 399/138
5,255,063 10/1993 Ideyama et al. ..... 399/51 X

FOREIGN PATENT DOCUMENTS 02-084675 3/1990 Japan .
06-130512 5/1994 Japan .

*Primary Examiner*—Arthur T. Grimley
*Assistant Examiner*—Sophia S. Chen
*Attorney, Agent, or Firm*—Jordan and Hamburg

[57] ABSTRACT

A light source drive controlling device for use in an image forming apparatus is provided for controlling a light source for illuminating a surface of a document wherein the light amount of the light source is adjusted in accordance with a level of drive voltage supplied thereto by a light source driving device for supplying a drive voltage of a specified level to the light source. A scanning mechanism for moving the light source to and from a home position and a return position whereat scanning is completed moves the light source through an image reading start position whereat scanning an image of the document begins. A drive voltage supply timing controller varies a drive voltage supply start timing for applying the drive voltage to the light source in accordance with the level of drive voltage such that the light amount of the light source reaches a predetermined level when the light source reaches the image reading start position.

15 Claims, 5 Drawing Sheets

LIGHT SOURCE DRIVE CONTROLLING DEVICE FOR USE IN IMAGE FORMING APPARATUS

BACKGROUND OF THE INVENTION

This invention relates to a light source drive controlling device for use in an image forming apparatus such as a copying machine, a facsimile machine, and a printer in which a light image of an original document image for image formation is obtained by moving a light source (exposure lamp) relative to the original document with the light source in an ON-state to emit light, and an image density for image formation is made adjustable by adjusting the light amount of the light source in accordance with a level of drive voltage to be supplied to the light source.

Conventionally, an image forming apparatus such as a copying machine comprises an optical system including a light source (exposure lamp) such as a halogen lamp, an imaging assembly including a photosensitive drum, and a sheet transport unit. In such image forming apparatus, the light source of the optical system is moved relative to a document, while emitting light to obtain a document light image (so-called image scanning).

Then, the thus obtained light image is guided toward the photosensitive drum to expose a certain area on the photosensitive drum, thereby forming an electrostatic latent image on the exposed area of the photosensitive drum surface. The latent image is developed into a toner image by a developing unit. The toner image is transferred onto a copy sheet fed from a sheet storage portion. The copy sheet carrying the transferred toner image is transported to a fixing unit after being separated from the photosensitive drum surface by a separation unit, and has the toner image fixed thereon.

In the above-constructed image forming apparatus, the light amount of the light source is adjustable to reproduce a document image with an optimum transfer density (i.e., to transfer the document image on a copy sheet with an optimum toner density) in accordance with the density of the original document image. More specifically, image scanning is controlled so that reading of the original document image is started after the light amount of the light source has reached a certain level corresponding to a level of drive voltage supplied to the light source. However, a time duration from a time at which the drive voltage is started to be supplied to the light source to a time at which scanning of the original document image is started to read the original document image, is set at a constant value.

In the above image forming apparatus provided with a halogen lamp as the light source, the following phenomenon happens. In the case where a drive voltage of high level is supplied to the light source, a so-called "rise-up time", a time duration from the start time of supplying a drive voltage to the light source and to the time at which the light amount of the light source reaches the set level where an image reading in a steady state for image formation with a constant density level is enabled becomes shorter, whereas in the case where a drive voltage of low level is supplied to the light source, the rise-up time becomes longer.

Accordingly, if the rise-up time is set longer at the maximum value, predicting that a drive voltage supplied to the light source is low, the following drawback is unavoidable. When a drive voltage of high level is supplied, an image reading is not initiated even after the light amount of the light source has reached a level sufficient to enable image reading (for image formation with a stabilized image density). As a result, an excessive amount of power is consumed until image reading is started, which is a waste of energy.

This kind of problem related to energy consumption is particularly conspicuous in the case of successive image reading operations, such as the case where a certain number of copies are obtained from a single original document image by sequentially reading the document image the certain number of times and the case where a plurality of document images are sequentially read by an automatic document feeder, irrespective of the number of copies to be obtained from the document images.

The above image forming apparatus suffers from another problem. If a halogen lamp is employed as the light source, and the light source is continually driven for a longer period of time in a state that a drive voltage of high level is kept supplied thereto, it is highly likely that the temperature of peripheral devices disposed around the light source is raised, compared to the case where a drive voltage of low level is supplied. Accordingly, a cooling device of a larger scale is required to be installed in the image forming apparatus. This increases the production cost of the image forming apparatus, and increases the size of the apparatus as a whole.

SUMMARY OF THE INVENTION

In view of the above, it is an object of the invention to solve the above drawbacks residing in the prior art.

It is another object of the invention to provide a light source drive controlling device for use in an image forming apparatus capable of suppressing energy consumption as much as possible regardless of the level of drive voltage to be supplied to a light source.

It is yet another object of the invention to provide a light source drive controlling device for use in an image forming apparatus capable of suppressing a rise of the temperature of peripheral devices around the light source as much as possible.

To accomplish the above objects, the present invention is directed to a light source drive controlling device for use in an image forming apparatus comprising: a light source for illuminating a surface of a document wherein the light amount of the light source is adjusted in accordance with a level of drive voltage supplied thereto; light source driving means for supplying a drive voltage of a specified level to the light source; scanning means for driving the light source to move from a home position (HP) to a return position (RP) via an image reading start position (SP) for scanning an image of the document; and drive voltage supply timing control means for changing a drive voltage supply start timing to the light source in accordance with the level of drive voltage to render the light amount of the light source reach a predetermined level when the light source reaches the image reading start position (SP).

With this arrangement, the supply timing of drive voltage is controlled in accordance with the level of drive voltage supplied to the light source, and the drive voltage is started to be supplied to the light source so that the light amount of the light source reaches the predetermined level for optimum image density level at the time or by the time when the light source reaches the image reading start position. Accordingly, power consumption for the image forming apparatus and a rise of temperature of peripheral devices around the light source can be suppressed as much as possible.

The above and other objects, features and advantages of the present invention will become more apparent upon a reading of the following detailed description and drawings.

DETAILED DESCRIPTION OF THE PREFERRED EMBODIMENTS OF THE INVENTION

Figure 1:
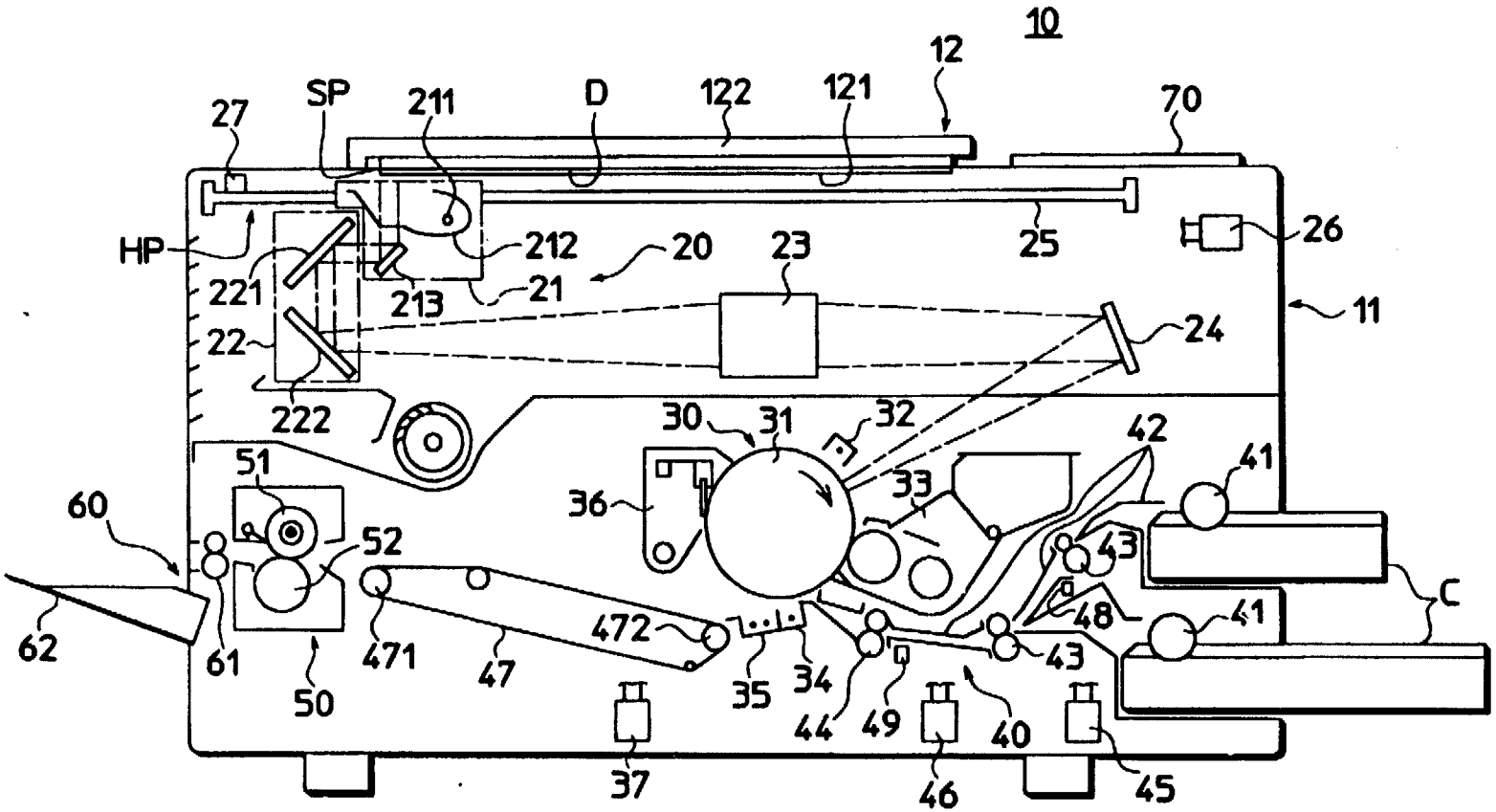
FIG. 1 is a diagram showing an internal arrangement of an embodiment of a copying machine incorporated with a light source drive controlling device according to this invention.

A preferred embodiment of this invention is described with reference to the accompanying drawings. FIG. 1 is a diagram showing an internal arrangement of a copying machine incorporated with a light source drive controlling device embodying the present invention. In this drawing, the copying machine 10 comprises a copying machine main body 11, and a document setting portion 12 provided at a top portion of the machine main body 11. It should be noted that a front and rear direction on the plane in FIG. 1 is the widthwise direction of the copying machine, while a left and right side direction on the plane in FIG. 1 is the lengthwise direction of the copying machine.

The machine main body 11 comprises an optical system 20, an imaging assembly 30 including a photosensitive drum 31, a sheet transport unit 40, a fixing unit 50, a sheet discharge unit 60, and an operating unit 70. The document setting portion 12 includes a contact glass 121 mounted over an opening in the top portion of the machine main body 11, and a document presser 122 operable to close and open the surface of the contact glass 121. The document presser 122 is adapted for manually setting a document D on the contact glass 121.

At a position SP (image reading start position) shown on a left end of the contact glass 121 in FIG. 1, there is an indicator plate extending in the widthwise direction of the copying machine. On the indicator plate, there are shown indexes indicative of a variety of document reference positions to designate the position at which documents of various sizes are to be placed on the contact glass 121.

The document setting portion 12 may include an automatic document feeder. In this case, a number of documents stacked on the automatic document feeder are successively fed to the surface of the contact glass 121 in a state that each document is set at the image reading start position SP. After an image of each document is read, the documents are successively discharged outside the automatic document feeder.

The optical system 20 includes a first optical unit 21, a second optical unit 22, a lens 23, and a reflective mirror 24. The first optical unit 21 has a light source (exposure lamp) 211 such as a halogen lamp, a reflector 212 for reflecting light emitted from the exposure lamp 211 toward the surface of the document D placed on the contact glass 121 to form a light image of the document image, and a reflective mirror 213 for directing the document light image in a horizontal direction.

The second optical unit 22 has reflective mirrors 221, 222 for guiding the document light image reflected by the reflective mirror 213 to the lens 23 which is adapted for focusing the light image on a surface of the photosensitive drum 31 of the imaging assembly 30. The reflective mirror 24 is adapted for guiding the focused light image passed through the lens 23 to an exposure position on the surface of the photosensitive drum 31.

The optical system 20 further comprises a pair of guide rails 25 along which the first and second optical units 21,.22 travel reciprocally, and an optical system drive motor 26 rotatable in forward and reverse directions to reciprocally move the first and second optical units 21, 22 at their respective travel speeds along the guide rails 25. The optical system 20 further has an optical unit detecting switch 27 at a position corresponding to the home position HP (left end side in FIG. 1) of the guide rails 25. The sensor switch 27 outputs an ON signal indicative of the presence of the first optical unit 21 when the first optical unit 21 is located at the home position HP.

When the optical system drive motor 26 is driven, the first optical unit 21 is reciprocally moved between the home position HP located leftward of the image reading start position SP in FIG. 1, and an image reading return position (i.e., rightmost of the image reading position for documents of various sizes) each of which is set in correspondence to the size of the document D placed on the contact glass 121 in the lengthwise direction of the copying machine.

When the motor 26 is driven in the forward direction to move the first optical unit 21 from the home position HP toward the return position, the light source 211 is turned on to emit light, thereby reading the original image of the document D. It is to be noted that the return position may be set at a fixed position corresponding to the lengthwise dimension of the document of the maximum size.

The imaging assembly 30 comprises the photosensitive drum 31 which is rotated in the clockwise direction at a constant speed, and further has a main charger 32, a developing unit 33, a transfer unit 34, a separating unit 35, and a cleaning unit 36 from an upstream side in this order in the periphery of the photosensitive drum 31 with respect to the rotating direction thereof. The main charger 32 charges a circumferential surface of the photosensitive drum 31 at a specified potential level. A specified area on the charged surface is exposed to the document light image obtained by scanning operation of the first optical unit 21 to form an electrostatic latent image of the document image thereon.

The electrostatic latent image is developed into a toner image by electrically attracting toner by the developing unit. The thus formed toner image is transferred to a copy sheet in the transfer unit 34. The copy sheet carrying the transferred toner image is separated from the photosensitive drum surface by the separating unit 35, and is transported to the fixing unit 50.

The photosensitive drum 31 is rotated at a constant speed, driven by a main motor 37 provided at an appropriate position in the copying machine main body 11. Toner residuals on the circumferential surface of the photosensitive drum 31 after the image transfer are removed by the cleaning unit 36.

The sheet transport unit 40 is detachably mounted to a lower portion of the copying machine main body 11. The sheet transport unit 40 comprises a sheet storage portion C, sheet feed rollers 41, a transport guide 42, transport roller pairs 43, a registration roller pair 44, a feed roller drive motor 45, and a registration roller drive motor 46.

Specifically, the sheet storage portion C includes a plurality of cassettes vertically mounted one over another, each containing copy sheets of a specified size in a stacked state.

The sheet feed roller 41 is provided for each cassette and is adapted for dispensing the copy sheets contained in the designated cassette one by one. The transport guide 42 is adapted for guiding the copy sheet fed from the cassette from the upstream side to the downstream side with respect to the sheet transport direction. The transport roller pairs 43 include a separation roller pair arranged at an appropriate position along the transport guide 42.

The registration roller pair 44 is arranged near the photosensitive drum 31 along the transport guide 42, and is adapted for transporting a copy sheet transported along the transport guide 42 toward the photosensitive drum 31 in synchronism with an image reading timing of the document D by the first optical unit 21. The feed roller drive motor 45 is disposed at an appropriate position in the machine main body 11 to rotate the sheet feed roller 41 and the transport roller pairs 43. The registration roller drive motor 46 is disposed at an appropriate position in the machine main body 11 to rotate the registration roller pair 44.

The sheet transport unit 40 further includes, at the downstream side of the photosensitive drum 31, a transport belt 47 which is stretched between a pair of belt drive rollers 471 and 472. When the belt drive roller 471 is rotated forward by driving the main motor 37, the transport belt 47 is rotated forward to transport a copy sheet carrying a toner image to the fixing unit 50.

There is arranged a sheet detecting switch 48 at the downstream side of and near the upstream-side transport roller pair 43. The sensor switch 48 detects the presence or absence of copy sheet passing the transport roller pair 43, while controlling driving of the sheet feed roller 41. There is arranged a registration roller switch 49 located immediately upstream of the registration roller pair 44 to control driving of the registration roller drive motor 46.

The fixing unit 50 is adapted for fixing a transferred toner image onto a copy sheet, and includes a heater roller (upper roller) 51 and a presser roller (lower roller) 52. The heater roller 51 is internally provided with a heater. The presser roller 52 is pressed against the heater roller 51 by a certain pressing force thereby, a copy sheet transported to the fixing unit 50 via the transport belt 47 has the toner image fixed, while passing the fixing unit 50 in a state that the copy sheet is pressed against the heater roller 51.

The sheet discharge unit 60 is adapted for discharging a copy sheet after fixation outside the copying machine, and includes a sheet discharge roller pair 61 disposed downstream of the fixing unit 50, and a sheet discharge tray 62. It is to be noted that the heater roller 51 of the fixing unit 50 and the sheet discharge roller pair 61 of the sheet discharge unit 60 are driven by the main motor 37.

Figure 2:
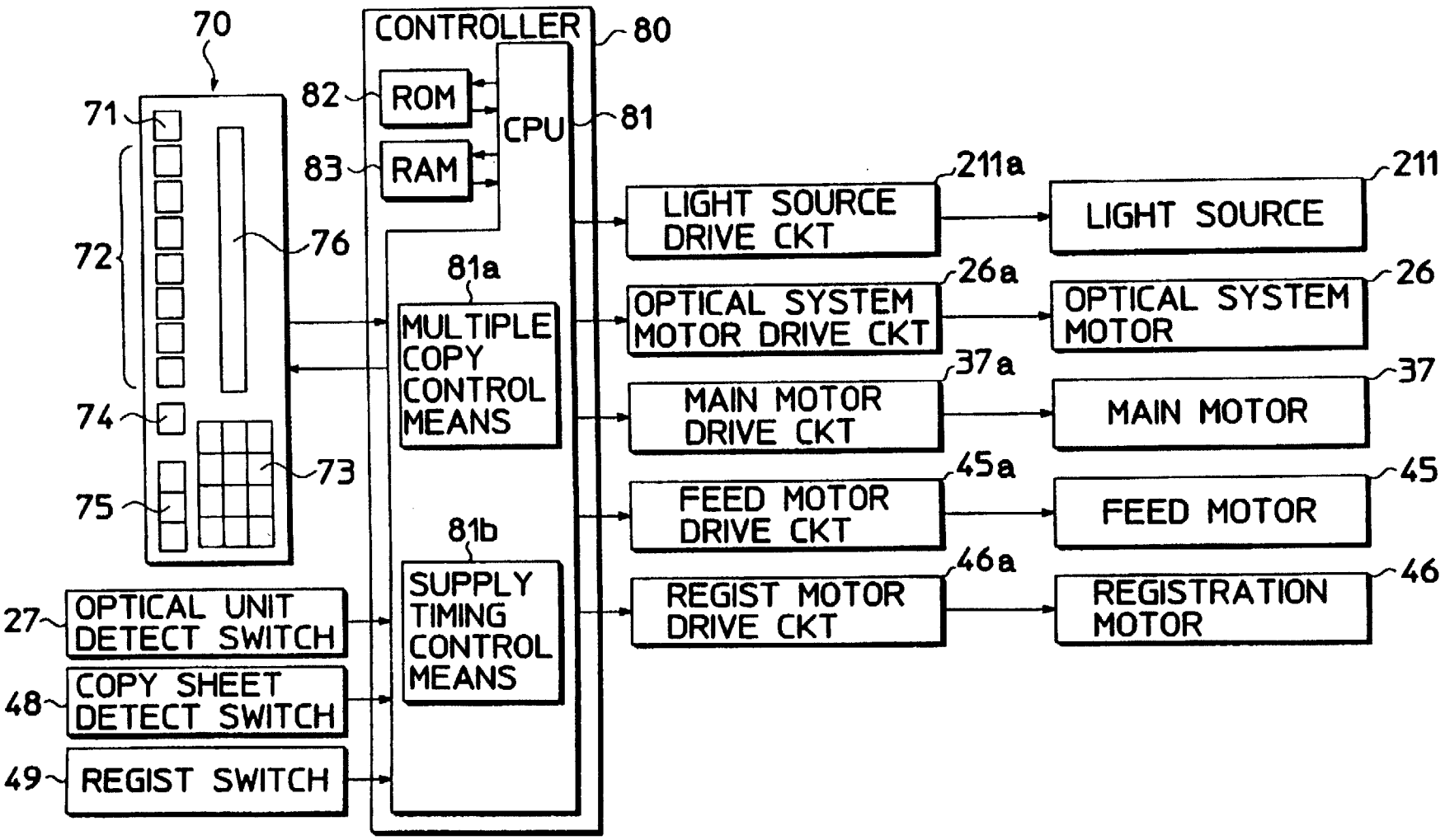
FIG. 2 is a block diagram primarily showing a control system of the copying machine.

The operating unit 70 is provided at an appropriate position on the top portion of the machine main body 11. As shown in FIG. 2, the operating unit 70 comprises a copy start switch 71 for designating start of a copying operation, exposure light amount adjust keys 72 which are manually operable to vary an exposure light amount of the light source 211 and are provided in correspondence to levels of exposure light amount, a copy number set key 73 including ten keys for setting the number of copies, a copy sheet size select key for selecting the size of copy sheet, a magnification rate set key 75, and a display portion 76 for displaying contents on copying operation.

FIG. 2 is a block diagram primarily showing a control system of the copying machine having the above construction. Indicated at 80 is a controller. The controller 80 comprises a CPU 81 for controlling an overall operation of the copying machine, an ROM 82 in which predetermined control programs for overall operation of the copying machine are stored, and an RAM 83 for temporarily storing data generated by a control processing operation.

The CPU 81 includes multiple copy control means **81*a* for setting a plurality of numbers of copies upon receiving a signal from the copy number set key 73, and drive voltage supply timing control means 81*b* for controlling a timing at which a drive voltage of a certain level is supplied to the light source 211**.

To the controller 80, there are connected the copy start switch 71, exposure light amount adjust keys 72, copy number set key 73, copy sheet size select key 74, magnification rate set key 75, and display portion 76 of the operating unit 70. There is also connected to the controller 80 the optical unit detecting switch 27 for detecting the presence of the first optical unit 21 at the home position HP.

To the controller 80, there are also connected a light source drive circuit **211*a* for controlling on and off of the light source 211, an optical system motor drive circuit 26*a* for controlling driving of the optical system drive motor 26, a main motor drive circuit 37*a* for controlling driving of the main motor 37, a feed motor drive circuit 45*a* for controlling driving of the feed roller drive motor 45, and a registration roller motor drive circuit 46*a* for controlling driving of the registration roller drive motor 46. The controller 80 administrates the reading start position SP, return position for each document D, etc. on the basis of the number of drive pulses supplied to the optical system drive motor 26**.

The light source drive circuit **211*a* has a power circuit constructed in such a manner that seven different levels of drive voltage ranging from, e.g., 50 V (minimum voltage level) to 85 V (maximum voltage level) can be variably outputted in a stepwise manner. Specifically, the light source drive circuit 211*a* varies the light amount of the light source 211 by selecting a level of drive voltage suitable for optimum image formation, from among the plurality of levels of drive voltage, and supplying the drive voltage of the selected level to the light source 211**.

More specifically, the lower the drive voltage level supplied to the light source 211, the less the light amount of the light source 211 emits, thereby increasing the image density with which the original image of the document D is to be transferred to a copy sheet. On the contrary, the higher the drive voltage level, the more the light amount of the light source 211 emits thereby decreasing the image density. Taking advantages of this characteristic, a certain level of drive voltage is selected to obtain a transferred image with an optimum image density, considering the density of the original document and other factors.

Each of the exposure light amount adjust keys 72 corresponds to a level of drive voltage which is outputted variably from the light source drive circuit **211*a*. When one of the exposure light amount adjust keys 72 for designating a certain exposure light amount level is depressed (turned to an ON state), a drive voltage of a certain level is selectively outputted from the light source drive circuit 211*a* so as to set the light amount of the light source 211 at the predetermined level. Thus, the light source drive circuit 211*a* supplies the drive voltage of the certain level to the light source 211**.

The controller 80 controls the light source drive circuit **211*a* to supply the thus set drive voltage to the light source 211 at a certain timing in association with seven different levels of drive voltage and scanning operation of the first optical unit 21, using the supply timing control means 81*b***.

Figure 5:
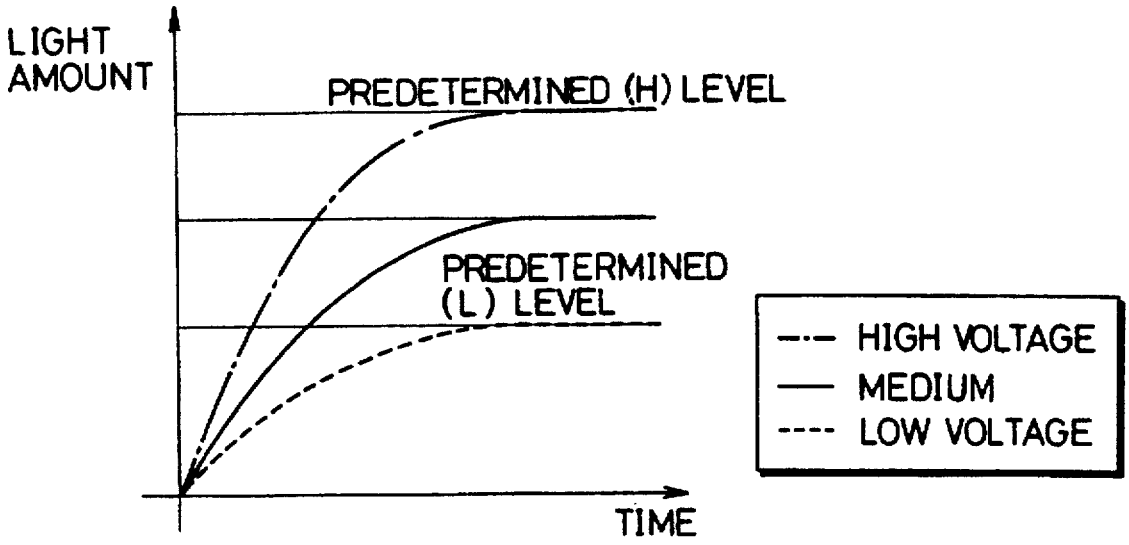
FIG. 5 is a graph showing rise-up curves of light amount versus time for various voltage values.
Figure 6:
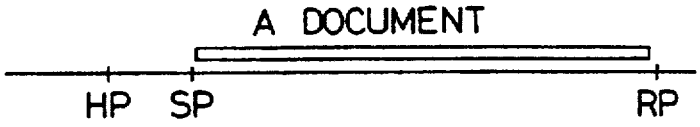
FIG. 6 is a diagram showing relationships among home position (HP), image reading start position (SP), and return position (RP).

More specifically, if a drive voltage of high level is supplied to the light source 211 such as a halogen lamp, a slope of a rise-up curve vs. time becomes steep, because the light amount of the light source 211 reaches a predetermined (high) level within a relatively short period, as represented by a curve — - — in FIG. 5. In this case, if such high level drive voltage is supplied to the light source 211 in a state that the first optical unit 21 (the light source 211) is at the home position HP, the light amount of the light source 211 reaches the predetermined level well before the first optical unit 21 reaches the image reading start position SP, during forward movement of the first optical unit 21 from the home position HP toward the return position RP as timed with the start of supplying the drive voltage to the light source 211.

Accordingly, in the case where the drive voltage supplied to the light source 211 is set at a high level, start of supplying the drive voltage to the light source 211 is deferred from start of scanning of the first optical unit 21 from the home position HP. In other words, the voltage supply timing is set to initiate after a certain time from the start of scanning (moving) of the first optical unit 21 from the home position HP in order that the light amount of the light source 211 reaches the predetermined level exactly when the first optical unit 21 reaches the reading start position SP or immediately before reaching the position SP.

On the contrary, in the case where a drive voltage of low level is supplied to the light source 211, the slope of the rise-up curve vs. time becomes gentle. This means that a longer time is required for the light amount of the light source 211 to reach a predetermined (low) level, as represented by a curve - - - in FIG. 5. In this case, if the drive voltage is supplied to the light source 211 at the same time as in the case where a drive voltage of high level is supplied to the light source 211, the light amount of the first optical unit 21 does not reach the predetermined level even when the first optical unit 21 has already reached the image reading start position SP.

Accordingly, in the case where a drive voltage supplied to the light source 211 is set at a low level, the drive voltage is supplied to the light source 211 within a relatively short period after the first optical unit 21 starts moving from the home position HP for image scanning in order that the light amount of the light source 211 reaches the predetermined level at a time when the first optical unit 21 reaches the image reading start position SP or immediately before reaching the position SP.

More specifically, in the case where the drive voltage level supplied to the light source 211 is set high, the timing of supplying the drive voltage is deferred, whereas the timing is advanced in the case where the drive voltage level supplied to the light source 211 is set low. Thereby, the light amount of the light source 211 reaches the predetermined level when the first optical unit 21 reaches at least the image reading start position SP.

It is to be noted, however, in this embodiment, start timing of supplying the drive voltage to the light source 211 is set in synchronism with turning on of the copy start switch 71, when a copying operation is executed for the first time, i.e., to a first copy sheet, irrespective of the level of drive voltage. The reason for setting so is described later.

In this embodiment, a time required for the light source 211 to reach the predetermined level, i.e., a time duration from the start time of supplying the drive voltage to the light source 211 to the time when the first optical unit 21 reaches the image reading start position SP or just before reaching the position SP, is referred to as a rise-up control time for the light source. In this embodiment, as shown in FIG. 3, the rise-up control time is set stepwise block by block in such a manner that each block has a specified range of drive voltage level.

Figure 3:
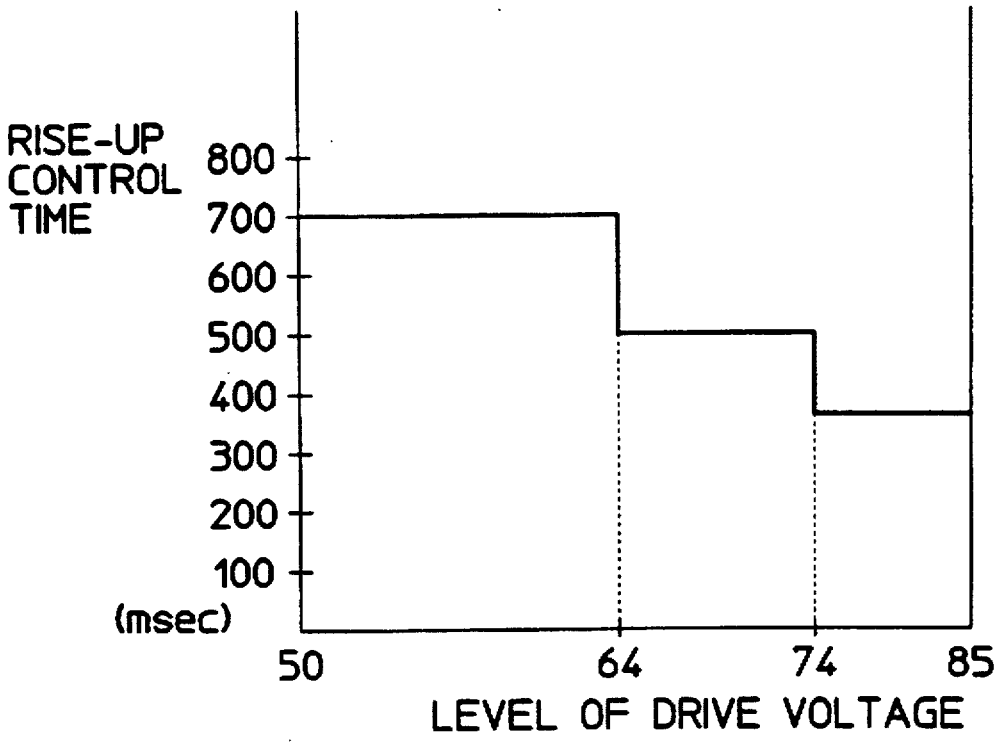
FIG. 3 is a graph showing a relationship between a range of a drive voltage level supplied to a light source and a rise-up control time for the light source.

For example, in this embodiment, the rise-up control time is set such that the time duration is 700 msec (milliseconds) when the drive voltage level is ranged from 50 V to 64 V; the time duration is 500 msec when the drive voltage level is ranged from 65 V to 74 V; and the time duration is 370 msec when the drive voltage level is ranged from 75 V to 85 V (see FIG. 3).

More specifically, in the case where the drive voltage level lies in the range of 50 V to 64 V, supply of drive voltage to the light source 211 is initiated 700 msec before the point of time when the first optical unit 21 reaches the image reading start position SP. In the case where the drive voltage level lies in the range of 65 V to 74 V, supply of drive voltage to the light source 211 is initiated 500 msec before the point of time when the first optical unit 21 reaches the image reading start position SP. In the case where the drive voltage level lies in the range of 75 V to 85 V, supply of drive voltage to the light source 211 is initiated 370 msec before the point of time when the first optical unit 21 reaches the image reading start position SP.

In this way, the rise-up control time is controllably settable in correspondence to the level of drive voltage supplied to the light source 211, thereby suppressing loss of energy consumption and a rise of temperature of peripheral devices around the light source 211 as much as possible.

In this embodiment, the rise-up control time is set variable stepwise block by block of drive voltage level. Alternatively, the rise-up control time may be set variable each time the drive voltage is leveled up or down corresponding to seven different levels of drive voltage.

In this embodiment, the level of drive voltage outputted from the light source drive circuit 211*a* is set stepwise, (discontinuously). Alternatively, the relationship between the drive voltage level and the rise-up control time may be set in linearly continuous manner. It is to be noted that data on the various rise-up control times are stored in the ROM 82 in association with the drive voltage level. While reading out, from the ROM 82, the rise-up control time corresponding to a designated drive voltage level, the CPU 81 controls the light source drive circuit 211*a* to supply a drive voltage of the designated level to the light source 211 at a certain timing in correspondence to the rise-up control time.

Designation of the drive voltage level may be automatically executed, without manual operation using the exposure light amount adjust keys 72. In such case, the operating unit 70 may be provided with a manual/auto select switch, and document density detecting means (sensor) may be arranged along an optical path for forming a light document image via a retractable mirror. With this arrangement, when the copying machine is set to the auto mode (or under the condition that no exposure light amount adjust key 72 is operated), the document density detecting means may be allowed to detect the image density of the document D, while moving the first optical unit 21 for pre-scanning.

Also, the ROM 82 may be provided with a look-up table in which the detected image density and a level of drive voltage at which an optimum light amount is obtainable are stored in association with each other. The CPU 81 may control the light source drive circuit 211*a* to output a drive voltage of a certain level which is set desirably to obtain an optimum (exposure) light amount based on a detection result outputted from the density sensor.

To sum it all up, when the copying machine is set at the manual mode, the exposure light amount adjust keys 72 constitute exposure light amount designator means, whereas the document density sensor and the ROM 82 provided with the look-up table (and its equivalent) constitute the exposure light amount designator means when the copying machine is set at the auto mode.

Next, operations of the copying machine 10 having the above control system are described with reference to a timing chart shown in FIG. 4.

First, a document D is set on the document setting portion 12 of the copying machine 10, the exposure light amount and the number of copies are set by operating one of the exposure light amount adjust keys 72 and the copy number set key 73 respectively, and the copy sheet size select key 74 is operated to designate a specified size of copy sheet. Thereby, the copying machine is put into a copy enabled state.

The exposure light amount may be automatically set based on the image density detected by pre-scanning operation of the first optical unit 21. The copy sheet size may be automatically set on the basis of the size of original document and the set magnification rate.

Subsequently, when the copy start switch 71 of the operating unit 70 is depressed to turn to an ON-state, the main motor 37 is driven to rotate the photosensitive drum 31, the roller 471 of the transport belt 47, and the heater roller 51 of the fixing unit 50 until the copying operation is completed. At this time, the roller 471 and the heater roller 51 may be rotated for a certain time period from feeding of the copy sheet from a cassette to passing of the copy sheet through the fixing unit 50.

At the same time of turning on of the copy start switch 71, a drive voltage is supplied to the sheet feed drive motor 45, which, in turn, is controllably driven for a predetermined time duration T1. Thereby, the copy sheet feed roller 41 is rotated to feed a copy sheet in the designated cassette of the sheet storage portion C to the transport guide 42. The copy sheet thus transported to the transport guide 42 is further transported to the registration roller pair 44 until a lead end of the copy sheet reaches the roller pair 44, while being transported by the transport roller pair 43 which is driven simultaneously with the rotation of the sheet feed roller 41.

When the copy sheet is fed to the transport guide 42, the sheet detecting switch 48 is turned to an ON-state. Then, the feed roller 41 has its rotation halted by an actuation of an unillustrated clutch in response to turning on of the switch 48. The registration roller pair 44 is driven as timed with driving of the optical system drive motor 26. Since the registration roller pair 44 is not yet started rotating at the time when the lead end of the copy sheet has reached the registration roller pair 44, the transport of the copy sheet is temporarily suspended at this point of time.

It is to be noted that when a copy sheet is dispensed from the cassette, the sheet detecting switch 48 is turned to an ON-state to detect the presence of copy sheet passing the transport roller pair 43 and outputs a detection signal indicative of the presence of copy sheet for a certain time duration T2. The time duration T2 is set in accordance with the size of copy sheet. A judgment as to whether the copy sheet is fed in a normal state, (e.g., whether a multiple feeding of copy sheet has occurred or not) is made by monitoring the detection signal outputted from the sheet detecting switch 48 during this time duration T2.

When a small time period lapses after the lead end of the copy sheet has reached the registration roller pair 44, the registration roller drive motor 46 and the optical system drive motor 26 are rotated synchronously. Thereby, the copy sheet is transported toward the photosensitive drum 31. The registration roller drive motor 46 is driven for a certain time duration T3, which is necessary for the copy sheet to be completely transported to the photosensitive drum 31.

Further, at the same time of turning on of the copy start switch 71, a drive voltage corresponding to a level designated by the exposure light amount set key 72 is supplied to the light source 211 of the first optical unit 21 to thereby cause the light source 211 to emit light. When the copy start switch 71 is turned on, the optical unit detecting switch 27 is turned to an ON-state, since the first optical unit 21 is located at the home position HP. In this state, the optical system drive motor 26 is in an OFF-state (not actuated).

Then, at the same time of refeeding of the copy sheet whose transport is temporarily suspended at the registration roller pair 44, the optical system drive motor 26 is rotated in the forward direction by a number of drive pulses corresponding to a distance from the home position HP to the return position RP corresponding to the document size (in this embodiment, the number of drive pulses corresponds to the time duration T4).

With this arrangement, when the first optical unit 21 starts moving from the home position HP and reaches the image reading start position SP in a state that the light source 211 is in an ON-state (to emit light), an image reading operation of the document D is started. Since the first optical unit 21 is away from the home position HP synchronously with start of forward rotation of the optical system drive motor 26, the optical unit detecting switch 27 is turned to an OFF-state upon start of the forward rotation of the optical system drive motor 26. Thereupon, counting of the number of drive pulses is started. Counting operation is performed to control a drive voltage supply start timing at which a drive voltage of the designated level is started to be supplied to the light source 211 for a second image forming operation (copying operation on the second copy sheet). The counting operation is described later.

A light image of the original document D obtained by scanning operation of the first optical unit 21 is introduced to the rotating photosensitive drum 31 to form an electrostatic latent image on the surface of the photosensitive drum 31 at a density level corresponding to the light amount of the light source 211. The thus formed latent image is developed into a toner image, which, in turn, is transferred to a copy sheet transported by the registration roller pair driven synchronously with the driving of the optical system drive motor 26. The copy sheet carrying the transferred toner image is transported to the fixing unit 50 by the transport belt 47 for image fixation. Thereafter, the copy sheet carrying the fixed transferred image is discharged onto the sheet discharge tray 62.

After completion of the image reading of the document D, i.e., when the first optical unit 21 reaches the return position, the optical system drive motor 26 is rotated in the reverse direction opposite to the forward direction at a high speed, counted up by the number of drive pulses identical to the number supplied thereto for the forward rotation (in this embodiment, the number of pulses for the reverse direction corresponds to the time duration T5).

Thereby, the first optical unit 21 is returned to the home position HP. The light source 211 is controlled to turn to an OFF-state when the first optical unit 21 reaches the return position RP or when the supply of drive voltage to the light source 211 is suspended in synchronism with the reverse rotation of the optical system drive motor 26.

When the first optical unit 21 is returned to the home position HP, the optical unit detecting switch 27 is turned to an ON-state. Then, after returning to the home position HP and having its movement suspended for the predetermined time duration T6, the first optical unit 21 starts to scan the surface of the document D placed on the contact glass 121 by the optical system drive motor 26 rotating in the forward direction by the predetermined number of drive pulses. Thus, copying operation for the second copy sheet (second image forming operation) is initiated.

As mentioned above, in the first image forming operation, the light source 211 is in an ON-state with the drive voltage being supplied thereto before the first optical unit 21 starts moving from the home position for image scanning. However, in the second image forming operation and thereafter, the light source 211 is turned to an ON-state with the drive voltage being supplied thereto after the optical system drive motor 26 starts rotating in the forward direction to move the first optical unit 21 from the home position for image scanning in order that the light amount of the light source 211 reaches the predetermined level at a point of time or by the time when the first optical unit 21 reaches the image reading start position SP. The drive voltage supply start timing at which the drive voltage is started to be supplied for the second image forming operation and thereafter is controlled by counting a certain time from the start time of moving the first optical unit 21 from the home position HP for the first image forming operation (i.e., at the point of time when the detection result of the optical unit detecting switch 27 is changed from an ON-state to an OFF-state).

Figure 4:
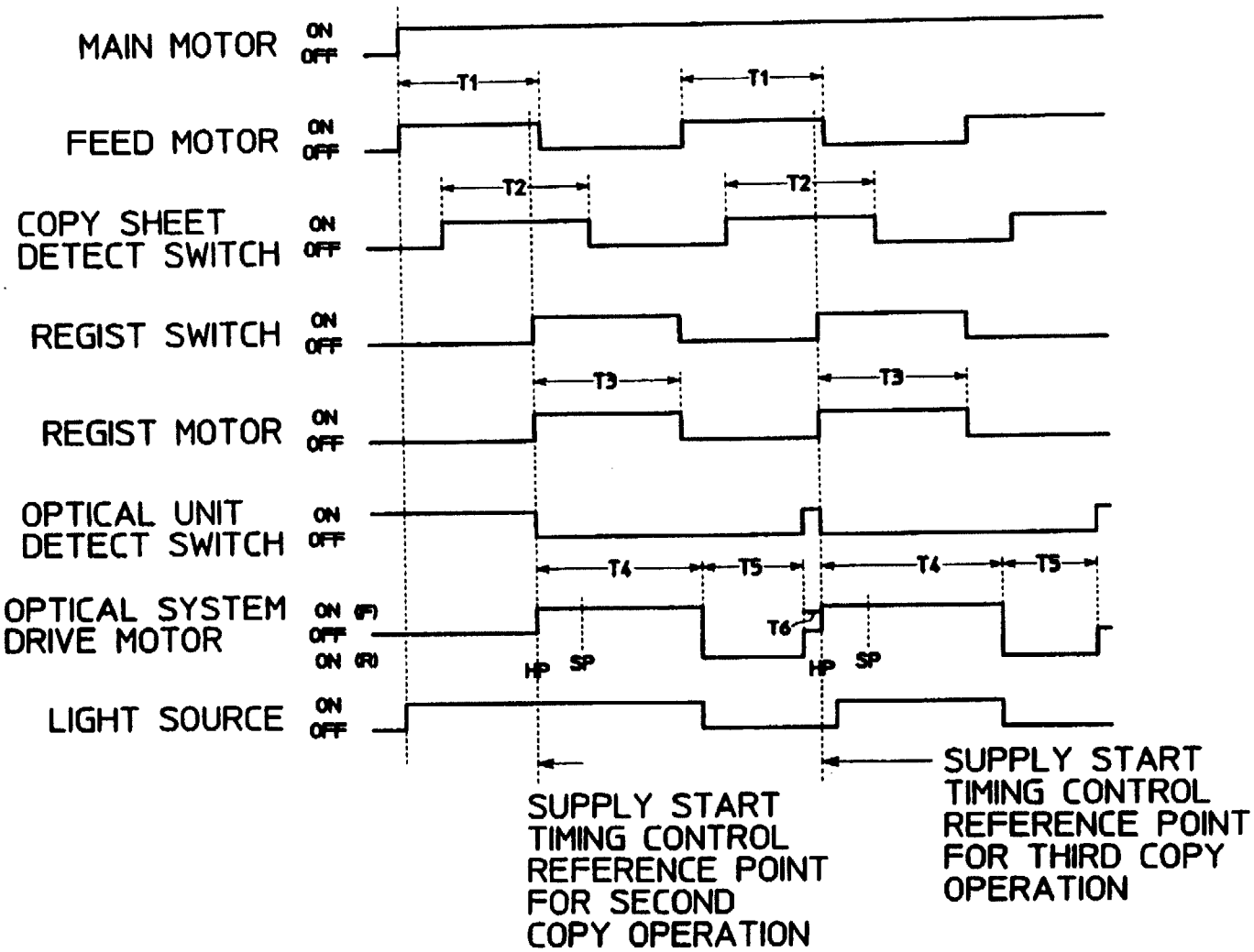
FIG. 4 is a timing chart showing ON/OFF control timings of various elements of the copying machine.

Specifically, as shown in FIG. 4, in the second image forming operation and thereafter, the start time of forward rotation of the optical system drive motor 26 in the previous copying operation is set as the reference point of time for controlling the drive voltage supply start timing in the current copying operation. The above setting of reference point is because of the following reason.

In the first image forming operation, supply of the drive voltage is controlled such that the drive voltage is started to be supplied to the light source 211 at the same time of turning on of the copy start switch 71, considering the fact that in the first image forming operation, there does not exist a reference point for accurately controlling a supply start timing of supplying a drive voltage to the light source 211 and etc.

On the other hand, in the second image forming operation and thereafter, the drive voltage supply start timing is controlled on the basis of the above reference point of time. That is, the drive voltage supply start timing for the second image forming operation and thereafter is controlled by setting the point of time when the first optical unit 21 starts moving from the home position HP in the previous copying operation as the reference point of time. Accordingly, there can be assuredly controlled the drive voltage supply start timing even in a case where the light source 211 is required to be put in an ON-state before the first optical unit 21 starts moving from the home position HP, considering that the drive voltage level is set low and it takes a longer time for the light source 211 to reach the light amount of set level.

With this arrangement, even in a case where the drive voltage supply start timing is deferred from the moving (scanning) start timing of the first optical unit 21 in a state that the drive voltage level is set at the minimum value, the supply start timing can be desirably controlled in the following manner.

Specifically, in the second image forming operation and thereafter, the supply start timing can be controlled on the basis of the moving start time of the first optical unit 21 from the home position HP in the current copying operation, or on the basis of the point of time when the first optical unit 21 is returned to the home position HP after image reading operation of the document D for the previous copying is completed (i.e., point of time when the optical unit detecting switch 27 is changed from an OFF-state to an ON-state).

On the other hand, the feed roller drive motor 45 is rotated again after the predetermined time duration T1 lapses, i.e., after a certain time period lapses from the time when the first copy sheet is transported toward the photosensitive drum 31 by the registration roller pair 44. In response to the driving of the feed roller drive motor 45, the second copy sheet is fed from the designated cassette and transported to the registration roller pair 44. Then, the registration roller switch 49 is turned to an ON-state in synchronism with a rotation of the optical system drive motor 26 which is driven for the second image forming operation.

Then, the registration roller motor 46 is driven for a certain time duration until the registration roller switch 49 is turned to an OFF-state (in this embodiment, for the predetermined time duration T3) to reliably transport the second copy sheet toward the photosensitive drum 31. The thus transported second copy sheet has a toner image formed on the surface of the photosensitive drum 31 transferred thereon, and the copy sheet carrying the toner image is transported to the fixing unit 50, and then is discharged onto the sheet discharge tray 62. In this way, the above-mentioned copying operation is repeated a certain number of times to obtain copies of the certain number.

In the case where the rise-up control time of the light source 211 is variably settable each time the drive voltage level is designated, as in this embodiment, the drive voltage supply start timing can be controlled more accurately by considering the rotational speed of the optical system drive motor 26, as well as the level of drive voltage supplied to the light source. Specifically, the rotational speed of the optical system drive motor 26 is varied depending on the magnification rate and the like. Affected by a change of the rotational speed of the optical system drive motor 26 , also changed is the rise-up time required for the light source 211 to reach the predetermined level from the time when the motor 26 is started to be driven. Accordingly, the drive voltage supply start timing can be controlled more precisely by taking into account the rotational speed of the optical system drive motor 26 as another parameter.

Furthermore, in the case where the rise-up control time for the light source 211 is varied in accordance with the set drive voltage level as in this embodiment, the drive voltage supply start timing can be controlled more accurately by taking into account the time duration during which the light source 211 emits light. Specifically, the rise-up control time for the light source 211 is varied depending on the time duration during which the light source 211 is in an ON-state in the previous copying operation. Accordingly, the drive voltage supply start timing can be controlled more precisely by utilizing the time duration of ON-state of the light source 211 in the previous copying operation as another parameter.

To summarize the above, in order to control the drive voltage supply start timing with high precision, the ROM 82 of the controller 80 may allow to store a look-up table in which values of various factors (parameters) necessary for controlling the drive voltage supply start timing are set in relation with the drive voltage supply start timing. Thus, an optimum supply start timing can be selected by referring to the look-up table to supply the drive voltage of a predetermined level to the light source with the optimum supply start timing.

In this embodiment, in the second image forming operation and thereafter, the drive voltage supply start timing for the light source 211 is controlled on the basis of scan start time at which the first optical unit 21 is started moving from the home position HP in the previous image forming operation. Alternatively, the copying machine may be allowed to perform copying operations similar to the conventional copying machine until a certain number of image forming operations is finished, (i.e., without control of drive voltage supply start timing as mentioned above), and the control may be started after the number of copying operations exceeds a predetermined value. In such case, the drive voltage supply start timing may be controlled on the basis of scan start time of the first optical unit 21 which has moved in the image forming operation before the last one.

In the above embodiment, the light source drive controlling device of this invention is described with reference to a multiple copying operation where a plurality of numbers of copies are obtained from a single document D. Alternatively, the multiple copying operation may be such that a plurality of numbers of documents are successively fed by an automatic document feeder to obtain a copy for each document. In this case, the drive voltage supply start timing can be controlled similar to the above case.

In the aforementioned embodiment, the drive voltage supply start timing to the light source 211 in the first image forming operation is controlled as timed with turning on of the copy start switch 71. Alternatively, this timing may be controlled at an arbitrary point of time which is prior to the start time of forward rotation of the optical system drive motor 26 and after a certain time is elapsed upon turning on of the copy start switch 71 (e.g., at the time when the copy sheet detecting switch 48 or registration roller switch 49 is turned to an ON-state, or at a time after a certain time lapses upon turning on of these switches). With this arrangement, even in the first image forming operation, an excessive power consumption can be suppressed.

Further, in the foregoing embodiment, described is the case where the light source drive controlling device is employed in a copying machine. The light source drive controlling device of this invention is not limited to the above case, and applicable to various image forming apparatuses other than the copying machine, such as facsimile machine, printer, and image scanner.

As mentioned above, the light source drive controlling device for use in an image forming apparatus is provided with drive voltage supply start timing control means for altering a start timing of supplying a drive voltage to the light source in accordance with the level of drive voltage supplied to the light source in order that the light amount of the light source reaches the predetermined value at the time when the light source reaches at least the image reading start position for the document for image reading. Accordingly, power consumption required for the image forming apparatus and a rise of temperature of the peripheral devices around the light source can be suppressed as much as possible.

Further, as mentioned above, the light source drive controlling device of this invention may be constructed in such a manner that the drive voltage supply start timing control means controls the light source drive means (light source drive circuit) such that supply of drive voltage to the light source is initiated prior to the time when the light amount of the light source reaches the predetermined level to transfer the document image with an optimum image density level corresponding to the drive voltage level supplied to the light source, i.e., by the end of the rise-up control time for the light source. In this case, also, power consumption for the image forming apparatus and a rise of temperature of the peripheral devices around the light source can be suppressed effectively.

Further, as mentioned above, the light source drive controlling device of this invention may be constructed in such a manner that the drive voltage supply start timing control means controls the light source drive means to delay the drive voltage supply timing as the drive voltage level is increased. With this arrangement, also, power consumption for the image forming apparatus and a rise of temperature of the peripheral devices around the light source can be assuredly suppressed.

Moreover, as mentioned above, the light source drive controlling device of this invention may comprise the multiple copy control means for copying an image of a single document to a plurality of numbers of copy sheets and may be constructed such that the drive voltage supply start timing control means controls the supply start timing for the second image forming operation and thereafter. With this arrangement, the drive voltage supply start timing can be controlled more reliably.

Furthermore, as mentioned above, the drive voltage supply start timing may be determined on the basis of the scan start point of time of the light source which is mounted on the optical system and located on the home position. With this arrangement, control of the drive voltage supply start timing can be facilitated.

As mentioned above, the drive voltage supply start timing may be determined on the basis of the scan start point of time of the light source from the home position in the previous image reading operation. Thereby, the drive voltage supply start timing can be controlled even in a case where a drive voltage is required to be supplied to the light source prior to start of the scanning operation of the light source from the home position.

As mentioned above, the light source drive controlling device of this invention may comprise exposure light amount designator means (exposure light amount adjust keys) operable to designate the exposure light amount of the light source stepwise. In response to an operation of the exposure light amount designator means, an exposure light amount level is settable. A drive voltage level is settable in correspondence to the designated exposure light amount level, and the drive voltage supply start timing is settable for each level of drive voltage. In this way, an optimum exposure light amount suitable for image density of the original document can be selected with an easy operation, as well as easy control of the drive voltage supply start timing.

Although the present invention has been fully described by way of example with reference to the accompanying drawings, it is to be understood that various changes and modifications will be apparent to those skilled in the art. Therefore, unless otherwise such change and modifications depart from the scope of the invention, they should be construed as being included therein.

What is claimed is:

1. A light source drive controlling device for use in an image forming apparatus comprising:

a light source for illuminating a surface of a document, the a light amount emitted from the light source being adjustable in accordance with a level of drive voltage supplied thereto;

light source driving means for supplying a drive voltage of a specified level, corresponding to a set level, to the light source;

scanning means for scanning an image of the document by moving the light source from a home position through an image start reading position to a return position whereat said light source has completed a scan of the document; and drive voltage supply timing control means for controlling the light source driving means to vary a drive voltage supply start timing such that the drive voltage is applied to the light source in accordance with the set level of the drive voltage so that the light amount of the light source arrives at a predetermined maximum level when the light source is at a position in a range extending from a position between the home position and the image reading start position and a position at the image reading start position.

2. The light source drive controlling device according to claim 1, wherein the drive voltage supply timing control means controls the light source driving means to apply the drive voltage at the set level to the light source such that the light amount of the light source reaches the predetermined maximum level prior to when the light source reaches the image reading start position.

3. The light source drive controlling device according to claim 1, wherein the drive voltage supply timing control means controls the light source driving means to defer the drive voltage supply start timing as the drive voltage level increases.

4. The light source drive controlling device according to claim 1, wherein the drive voltage supply start timing is determined based on a scan start point at which the light source starts to move from the home position.

5. The light source drive controlling device according to claim 4, wherein the drive voltage supply start timing is determined based on the scan start point and the scan start point is that at which the light source starts to move from the home position in a previous image forming operation.

6. The light source drive controlling device according to claim 1, wherein the drive voltage supply timing control means controls the light source driving means to apply the drive voltage at the set level to the light source such that the light amount of the light source reaches the predetermined maximum level substantially at a point in time when the light source reaches the image reading start position.

7. The light source drive controlling device according to claim 1 further comprising a input device permitting a user to manual input the set level.

8. The light source drive controlling device according to claim 1, further comprising:

means for effecting scanning of the document with the set level at a predetermined density scanning level and detecting an image density of the image;

means for setting the set level to a level based on said image density detected; and means for performing a subsequent scanning of the document using the set level at the level based on said image density detected.

9. A light source drive controlling device for use in an image forming apparatus comprising:

a light source for illuminating a surface of a document, a light amount emitted from the light source being adjustable in accordance with a level of drive voltage supplied thereto:

light source driving means for supplying a drive voltage of a specified level corresponding to a set level, to the light source;

scanning means for scanning an image of the document by moving the light source from a home position through an image start reading position to a return position whereat said light source has completed a scan of the document, drive voltage supply timing control means for controlling the light source driving means to vary a drive voltage supply start timing in accordance with the set level of the drive voltage so that the light amount of the light source is at a predetermined level when the light source reaches the image reading start position: and multiple copy control means for performing a number of image forming operations forming the document image on a plurality of copy sheets such that the drive voltage supply timing control means varies the drive voltage supply start timing in accordance with the set level of the drive voltage in a second image forming operation of said number of said image forming operations and thereafter.

10. The light source drive controlling device according to claim 9, wherein the drive voltage supply start timing is determined based on a scan start point at which the light source starts to move from the home position.

11. The light source drive controlling device according to claim 10, wherein the drive voltage supply start timing is determined based on the scan start point and the scan start point is that at which the light source starts to move from the home position in a previous image forming operation.

12. The light source drive controlling device according to claim 9, wherein the drive voltage supply timing control means controls the light source driving means to apply the drive voltage at the set level to the light source such that the light amount of the light source reaches the predetermined level prior to when the light source reaches the image reading start position.

13. The light source drive controlling device according to claim 9, wherein the drive voltage supply timing control means controls the light source driving means to apply the drive voltage at the set level to the light source such that the light amount of the light source reaches the predetermined level substantially at a point in time when the light source reaches the image reading start position.

14. The light source drive controlling device according to claim 9, further comprising a input device permitting a user to manual input the set level.

15. The light source drive controlling device according to claim 9, further comprising:

means for effecting scanning of the document with the set level at a predetermined density scanning level and detecting an image density of the image;

means for setting the set level to a level based on said image density detected; and means for performing a subsequent scanning of the document using the set level at the level based on said image density detected.

* * * * *